US007173566B2

(12) United States Patent
Cheng

(10) Patent No.: US 7,173,566 B2
(45) Date of Patent: Feb. 6, 2007

(54) LOW-SIDELOBE DUAL-BAND AND BROADBAND FLAT ENDFIRE ANTENNA

(75) Inventor: Shih-Chieh Cheng, Tainan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/187,936

(22) Filed: Jul. 25, 2005

(65) Prior Publication Data

US 2006/0170594 A1 Aug. 3, 2006

(30) Foreign Application Priority Data

Feb. 2, 2005 (TW) ..... 94103280 A

(51) Int. Cl.
*H01Q 1/38* (2006.01)

(52) U.S. Cl. ..... 343/700 MS; 343/795

(58) Field of Classification Search ..... 343/700 MS, 343/702, 795

See application file for complete search history.

(56) References Cited

U.S. PATENT DOCUMENTS 5,293,175 A * 3/1994 Hemmie et al. ..... 343/795
6,703,985 B2 * 3/2004 Lee ..... 343/786
2004/0017315 A1 * 1/2004 Fang et al. ..... 343/700 MS
2006/0114166 A1 * 6/2006 Mohammadian et al. ... 343/795

* cited by examiner

*Primary Examiner*—Tan Ho
(74) *Attorney, Agent, or Firm*—Birch, Stewart, Kolasch & Birch, LLP

(57) ABSTRACT

A low-sidelobe dual-band and broadband flat endfire antenna includes a substrate, a first radiator, a second radiator, two refraction portions, and a conductive element. The substrate has a side surface, a first surface, and a second surface. The first radiator is disposed on the first surface and has a first oblique portion, a first concave portion, and a first electrically connecting portion disposed opposite to the first concave portion. The second radiator is disposed on the second surface and has a second oblique portion, a second concave portion, and a second electrically connecting portion disposed opposite to the second concave portion. The second oblique portion is disposed opposite to the first oblique portion to form an included angle. The refraction portions are disposed on the side surface and are opposite to one another. The conductive element has a conductive body and a grounded conductor electrically connected to the first conductivity portion and the second conductivity portion, respectively.

14 Claims, 6 Drawing Sheets

LOW-SIDELOBE DUAL-BAND AND BROADBAND FLAT ENDFIRE ANTENNA

BACKGROUND OF THE INVENTION

1. Field of Invention

The invention relates to an endfire antenna and, in particular, to a low-sidelobe dual-band and broadband flat endfire antenna operating a dual-band environment.

2. Related Art

The prosperous development in wireless transmission has brought us various kinds of multi-frequency transmission products and technologies. Many new products are built in with the function of wireless transmissions. The antenna is an important element for a wireless transmission system to emit and receive electromagnetic (EM) wave energy. Without the antenna, the wireless transmission system will not be able to emit and receive data. Therefore, the antenna is indispensable for wireless transmissions. Besides fitting to the product shape and enhancing transmissions, using an appropriate antenna can further reduce the product cost. The designs and materials of antennas vary in different products. As different countries use different bands, one has to take that into account to design the antennas. Commonly used standards of the bandwidths include IEEE 802.11 and the hottest Bluetooth communications (802.15.1). The Bluetooth technology works in the 2.4 GHz band. The 802.11 standard is further divided into 802.11a and 802.11b, defined for the 5 GHz band and the 2.4 GHz band, respectively.

Antennas can be divided into uni-directional antennas (or traveling wave antennas) and omni-directional antennas (or resonant wave antennas). Moreover, uni-directional antennas have several kinds of variations, such as the tape antennas or endfire antennas.

A well-known uni-directional antenna is shown in FIG. 1. A tape antenna 10 is disposed on a dielectric substrate 15. A grounded plane 16 and a tape plane 17 are formed on opposite surfaces of a plate. The grounded plane 16 and the tape plane 17 are comprised of several thin metal plates of millimeter (mm) thick. The side length of the tape plane 17 is $\lambda/2$ (where $\lambda$ is the wavelength of radio waves). A hole (not shown) is formed in the middle of the dielectric substrate 15. The core conductor 20 of a coaxial cable 19 goes through the hole and connects to the tape plane 17. Another hole 23 is formed on a support substrate 22. The coaxial cable 19 is installed by penetrating trough the hole 23. Moreover, the outer conductor of the coaxial cable 19 is connected to the grounded plane 16. The support substrate 22 is an insulator. A dielectric slab 27 is fixed on the support substrate 22 by a separator 26 disposed at corners of the substrate 22.

The above-mentioned uni-directional antenna can only operate in a single frequency band and is thus impractical for modem uses. Besides, the antenna involves high precision. Conventional manufacturing methods tend to be more complicated. Any errors in sizes or assembly alignment may change the operating frequency band of the antenna. All such effects will eventually increase the assembly cost of the antennas.

Therefore, it is an important subject in the field to provide a dual-band uni-directional antenna that has an increased operating bandwidth and a lower assembly cost.

SUMMARY OF THE INVENTION

In view of the foregoing, the invention is to provide a low-sidelobe dual-band and broadband flat endfire antenna that has broader operating bandwidths in two different frequency bands.

The disclosed low-sidelobe dual-band and broadband flat endfire antenna includes a substrate, a first radiator, a second radiator, a refraction portion, and a conductive element. The substrate has a side surface, a first surface, and a second surface opposite to the first surface. The first radiator is disposed on the first surface and has a first oblique portion, a first concave portion, and a first electrically connecting portion. The first oblique portion is opposite to the first concave portion. The second radiator is disposed on the second surface and has a second oblique portion, a second concave portion, and a second electrically connecting portion. The second oblique portion is opposite to the second concave portion. An included angle is formed between the first and second oblique portions. The refraction portion is disposed on the side surface of the substrate. The conductive element has a conductive body and a grounded conductor, which are electrically connected to the first conductivity portion and the second conductivity portion, respectively.

As mentioned above, the low-sidelobe dual-band and broadband flat endfire antenna of the invention makes use of a first oblique portion and a second oblique portion that are disposed opposite to each other and form an included angle to induce traveling waves of various frequencies toward specific directions. Moreover, it uses a first concave portion and a second concave portion to obtain desired impedance, so that the endfire antenna can operate in the dual-band mode. With the use of a refraction portion, the sidelobes emitted by the endfire antenna are deflected to increase the power density of the primary lobe and the gain.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
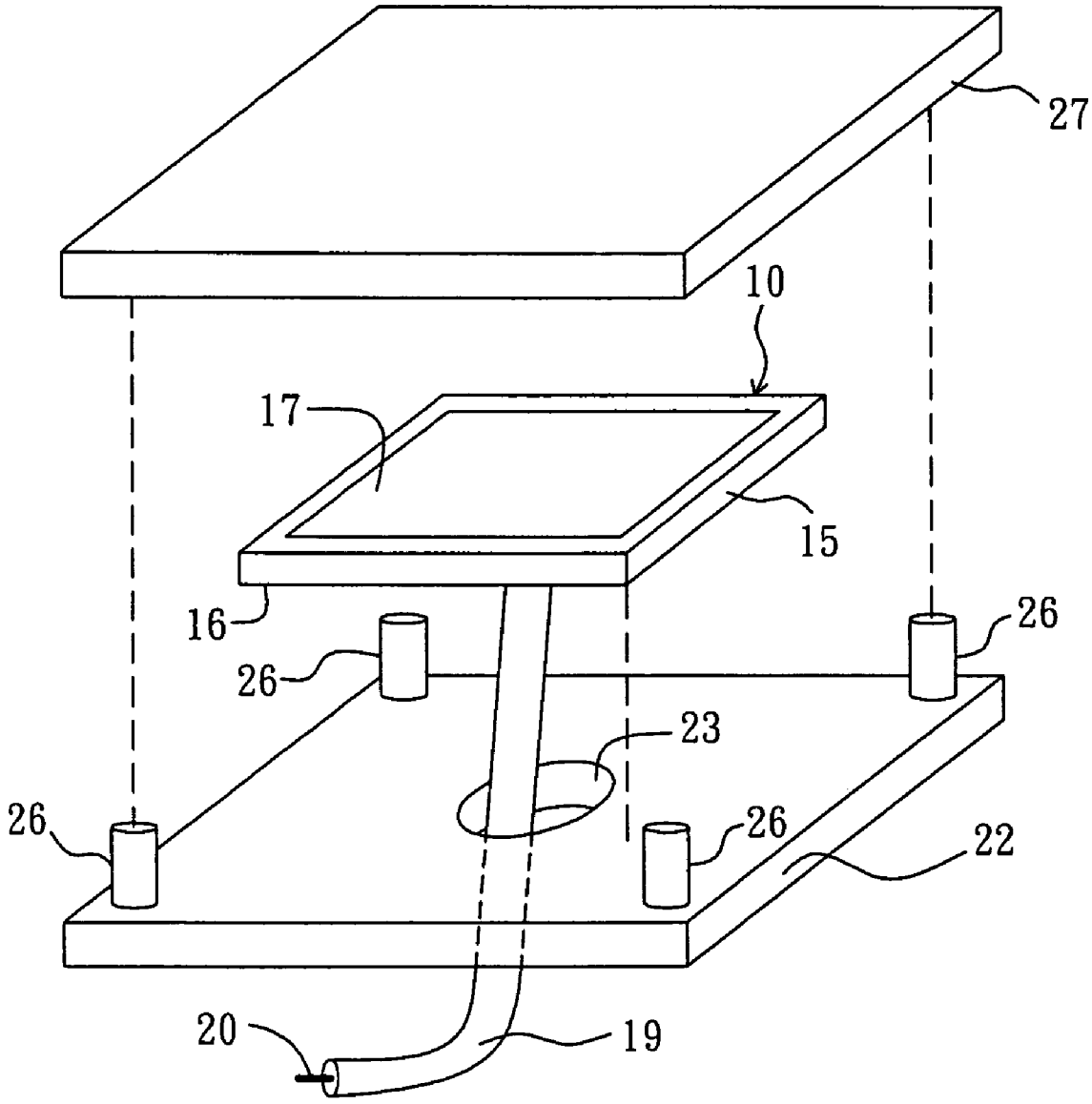
FIG. 1(PRIOR ART)
FIG. 1 is a schematic view of the conventional tape antenna.
Figure 2A:
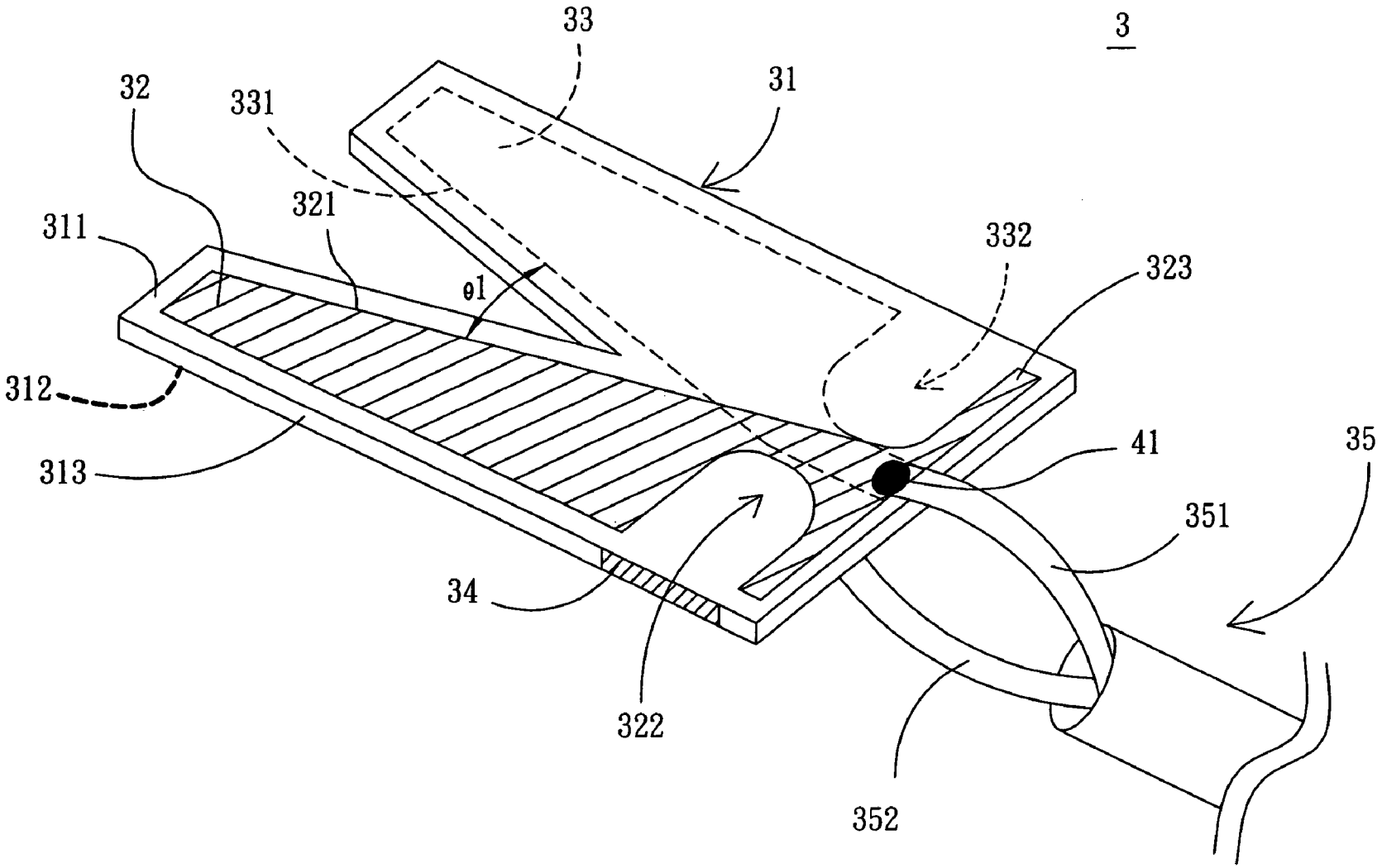
FIGS. 2A and 2B are schematic views of a low-sidelobe dual-band and broadband flat endfire antenna according to a preferred embodiment of the invention.

As shown in FIG. 2A, a low-sidelobe dual-band and broadband flat endfire antenna 3 according to the embodiment of the invention includes a substrate 31, a first radiator 32, a second radiator 33, a refraction portion 34, and a conductive element 35.

The substrate 31 has a first surface 311, a second surface 312 opposite to the first surface 311, and a side surface 313. The substrate 31 can be a printed circuit board (PCB) made of BT (bismaleimide-triazine) resin or FR-4 (fiberglass reinforced epoxy resin). It may also be a flexible film substrate made of polyamide. In this embodiment, the substrate 31 is made of FR-4.

The first radiator 32 is disposed on a first surface 311 of the substrate 31. It has a first oblique portion 321, a first concave portion 322 opposite to the first oblique portion 321, and a first electrically connecting portion 323.

The second radiator 33 is disposed on a second surface 312 of the substrate 31. The second radiator 33 has a second oblique portion 331, a second concave portion 332 opposite to the second oblique portion 331, and a second electrically connecting portion 333. The second oblique portion 331 and the first oblique portion 321 are opposite to each other and form an included angle θ1. In this embodiment, the included angle θ1 is between 20 degrees and 30 degrees. Moreover, the first radiator 32 and the second radiator 33 can be made of metal. In this embodiment, they are made of copper.

Figure 2B:
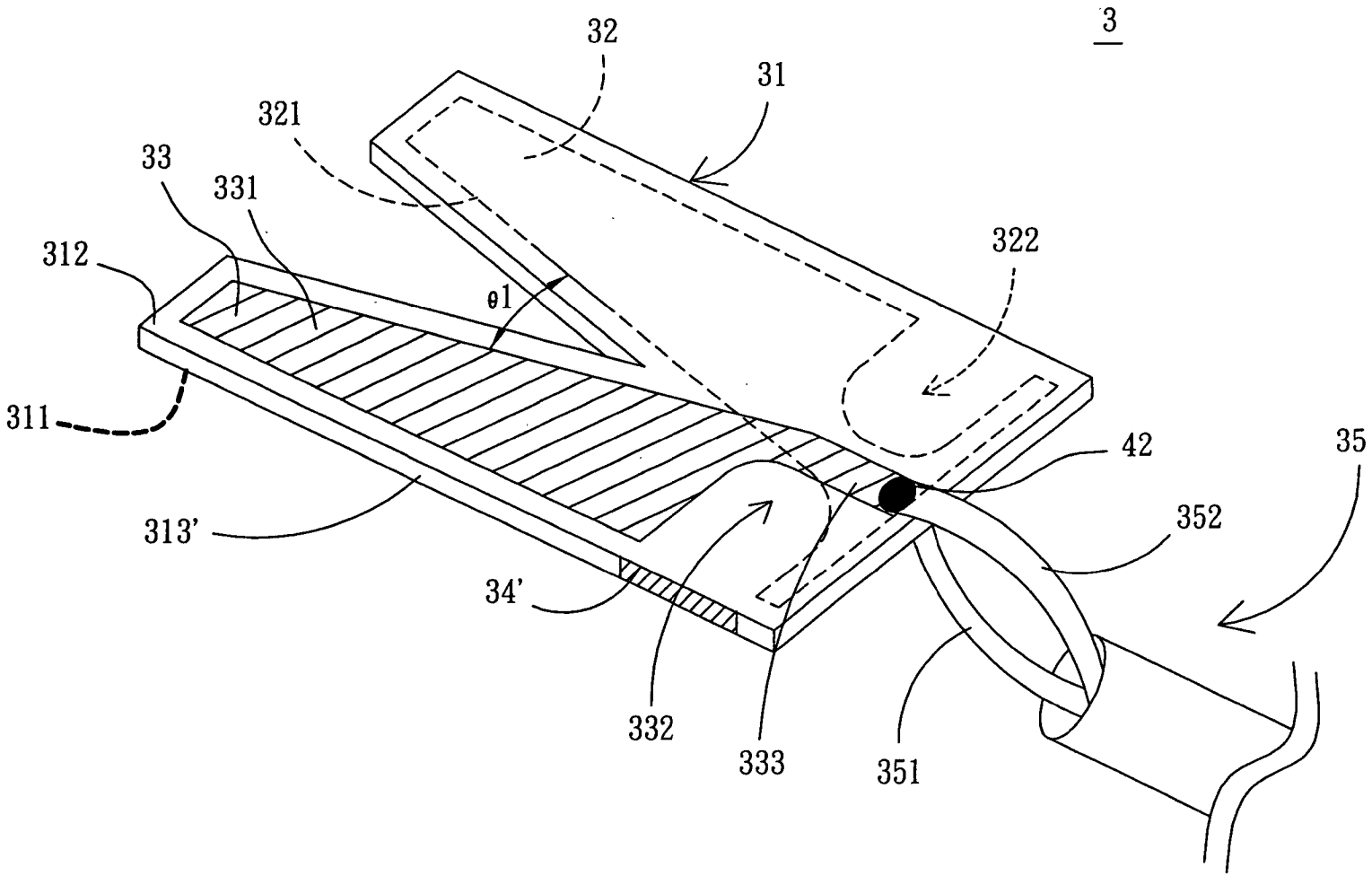

The refraction portion 34 is disposed on a side surface 313 of the substrate 31. It is disposed on the side surface 313 opposite to the first concave portion 322 (as shown in FIG. 2A). With reference to FIG. 2B, in the current embodiment, the low-sidelobe dual-band and broadband flat endfire antenna 3 further has another refraction portion 34', which is disposed on a side surface 313' opposite to the second concave portion 332. Moreover, the material of the refraction portion 34 can be metal. In this embodiment, they are made of copper, the same as the first radiator 31 and the second radiator 32.

Figure 3:
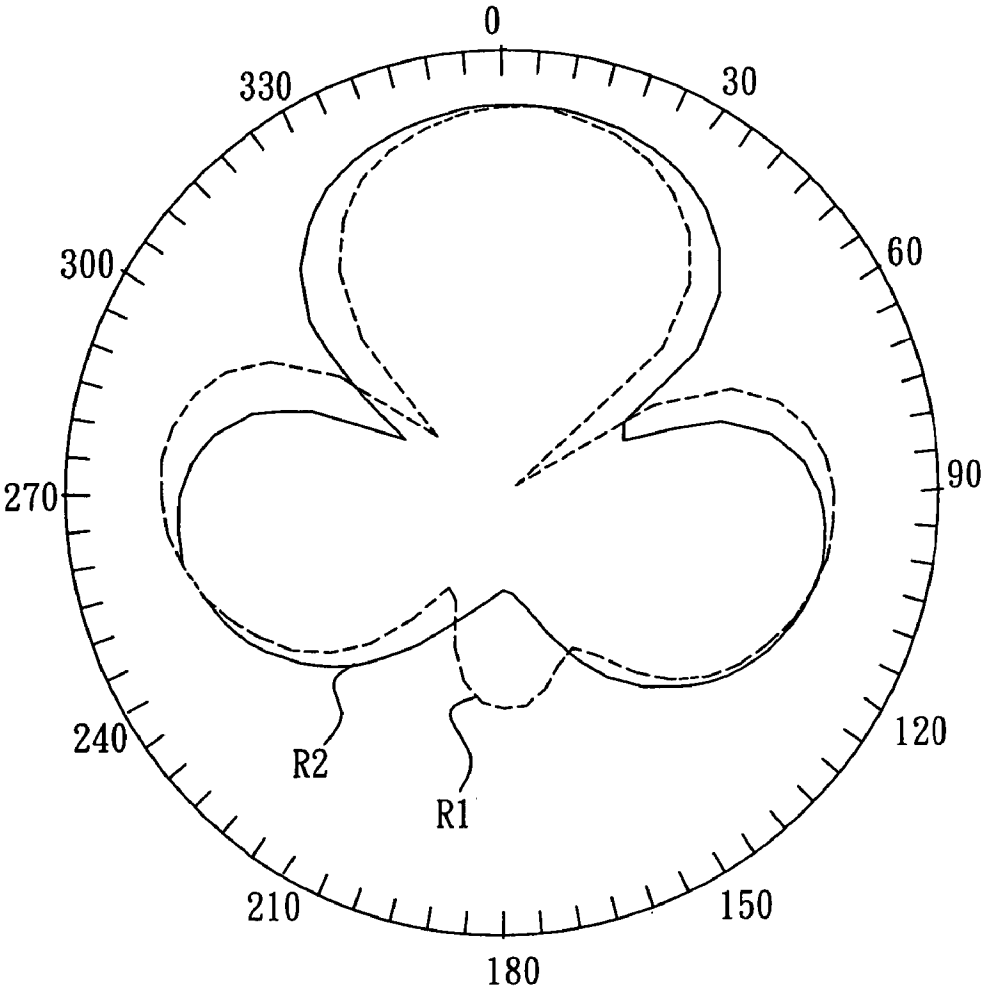
FIG. 3 shows the radiation field pattern of the low-sidelobe dual-band and broadband flat endfire antenna according to the preferred embodiment of the invention.

The refraction portion 34 deflects the sidelobes of the traveling wave generated by the first and second concave portions 322, 332 to the primary lobe of the low-sidelobe dual-band and broadband flat endfire antenna 3 to enhance its power density and result in a high gain. As shown in FIG. 3, the first radiation field pattern R1 is measured before the installation of the refraction portion 34, just as in the prior art. The second radiation field pattern R2 is measured after the installation of the refraction portion 34, as disclosed herein. It is observed that part of the sidelobes is deflected by the refraction portion 34 to the primary lobe, increasing the power density of the primary lobe. From FIG. 3, it is seen that the sidelobes of the second radiation field pattern R2 are lower than those in the first radiation field pattern R1. Therefore, the invention is called the "low-sidelobe" dual-band and broadband flat endfire antenna.

The conductive element 35 has a conductive body 351 and a grounded conductor 352 electrically connected to the first electrically connecting portion 323 and the second electrically connecting portion 333, respectively. In this embodiment, the conductive body 351 is electrically coupled to the first electrically connecting portion 323, and the grounded conductor 352 is electrically coupled to the second electrically connecting portion 333. However, the conductive body 351 can be electrically coupled to the second electrically connecting portion 333, and the grounded conductor 352 electrically coupled to the first electrically connecting portion 323. In this embodiment, the conductive element 35 can be a coaxial cable. In this case, the conductive body 351 is the central wire of the coaxial cable, and the grounded conductor 352 is the grounded part of the coaxial cable. Besides, the connection between the conductive element 35 and the first radiator 32 and the second radiator 33 varies according to the shape of the application product, as long as the conductive body 351 and the grounded conductor 352 are electrically coupled to the first electrically connecting portion 323 and the second electrically connecting portion 333, respectively.

In this embodiment, the first electrically connecting portion 323 further contains a first feed point 41 and the second electrically connecting portion 333 further contains a second feed point 42. The conductive body 351 and the grounded conductor 352 of the conductive element 35 are electrically coupled to the first feed point 41 and the second feed point 42, respectively.

Figure 4:
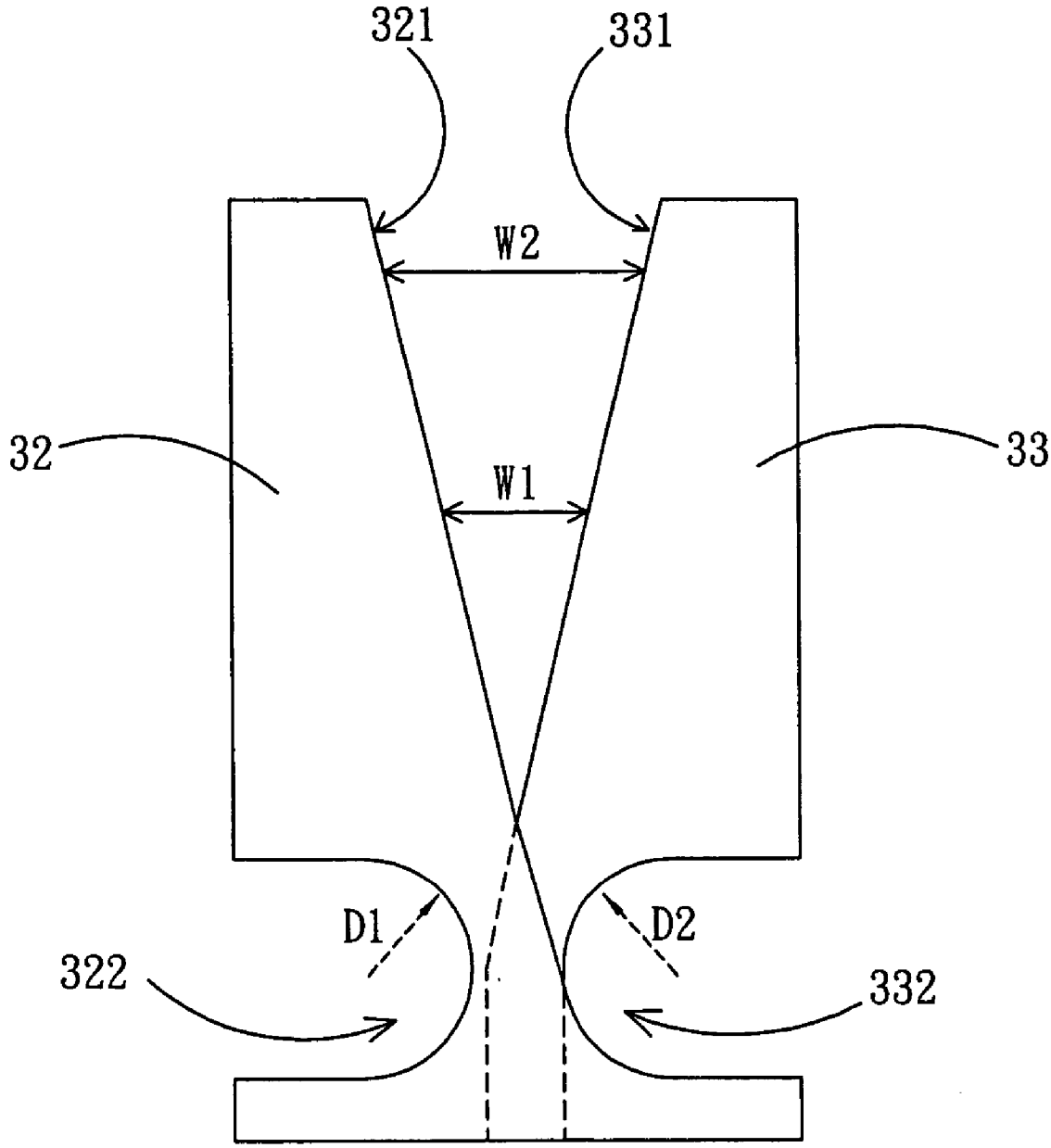
FIG. 4 is a schematic view of part of the application range of the low-sidelobe dual-band and broadband flat endfire antenna according to the preferred embodiment of the invention.

The disclosed low-sidelobe dual-band and broadband flat endfire antenna 3 uses a narrow-to-wide radiation portion formed by the first oblique portion 321 and the second oblique portion 331 to induce the traveling waves of different frequencies. Thus, it operates in two frequency bands. As shown in FIG. 4, the first width W1 induces high-frequency traveling waves, and the second width W2 induces low-frequency traveling waves. Moreover, the radius D1 of the first concave portion 322 and the radius D2 of the second concave portion 332 are roughly the same. In this embodiment, the radius D1 of the first concave portion 322 is between 5 mm and 8 mm.

Figure 5:
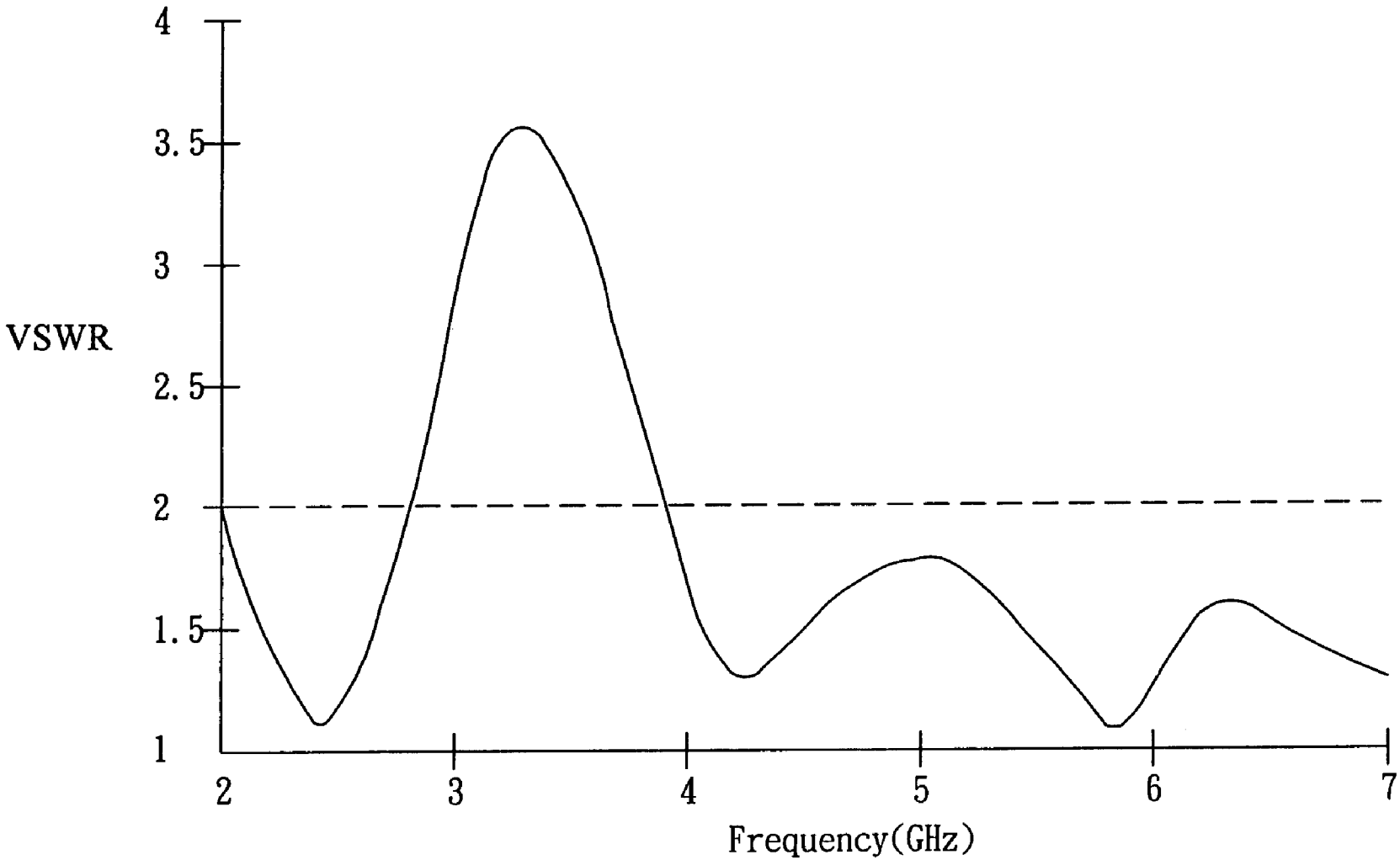
FIG. 5 shows a measurement of the application range of the low-sidelobe dual-band and broadband flat endfire antenna according to the preferred embodiment of the invention.

In this type of endfire antennas, the larger the width of the radiation portion for inducing traveling waves, the easier the antennas can operate in low frequencies. However, due to the consideration of sizes, enlarging the width of the radiation portion will enlarge the antenna size, too. Therefore, the invention fine-tunes the radii D1 and D2 of the first and second concave portions 322, 332 to obtain desired impedance match. Thus, the antenna can operate simultaneously in high and low frequency bands. In FIG. 5, the vertical axis represents the voltage standing wave ratio (VSWR) and the horizontal axis represents the frequency. A normally acceptable VSWR is about 2. If it is smaller than 2, the disclosed low-sidelobe dual-band and broadband flat endfire antenna 3 can operate in the 2.4 GHz band and the 5 GHz band. That is, it covers the frequency bands used by most of the countries in the world.

In summary, the disclosed low-sidelobe dual-band and broadband flat endfire antenna 3 makes use of a first oblique portion and a second oblique portion that are disposed opposite to each other and form an included angle to induce traveling waves of various frequencies toward specific directions. Moreover, it uses a first concave portion and a second concave portion to obtain desired impedance match, so that the endfire antenna can cover the low-frequency part (such as the 2.4 GHz band in the disclosed embodiment) for operating in the dual-band mode. With the use of a refraction portion, the sidelobes emitted by the endfire antenna are deflected to the primary lobe to increase the power density of the primary lobe and the gain. In comparison with the prior art, the invention uses simple devices to make the unidirectional antenna. The assembly cost is lower than the conventional method. Moreover, the invention can obtain an antenna operating in dual bands and broadband. Its wider applications can meet user's needs.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A low-sidelobe dual-band and broadband flat endfire antenna, comprising:

a substrate, which has a side surface, a first surface, and a second surface opposite to the first surface;

a first radiator, which is disposed on the first surface of the substrate and has a first oblique portion, a first concave portion, and a first electrically connecting portion, wherein the first oblique portion is opposite to the first concave portion;

a second radiator, which is disposed on the second surface of the substrate and has a second oblique portion, a second concave portion, and a second electrically connecting portion, wherein the second oblique portion is opposite to the second concave portion and forms an included angle with the first oblique portion;

a refraction portion, which is disposed on the side surface of the substrate; and a conductive element, which has a conductive body and a grounded conductor electrically coupled to the first electrically connecting portion and the second electrically connecting portion, respectively.

2. The low-sidelobe dual-band and broadband flat endfire antenna of claim 1, wherein the refraction portion is disposed on the side surface opposite to the first concave portion.

3. The low-sidelobe dual-band and broadband flat endfire antenna of claim 2, further comprising:

another refraction portion, which is disposed on the side surface opposite to the second concave portion.

4. The low-sidelobe dual-band and broadband flat endfire antenna of claim 1, wherein the included angle between the first oblique portion and the second oblique portion is between 20 degrees and 30 degrees.

5. The low-sidelobe dual-band and broadband flat endfire antenna of claim 1, wherein the radius of the first concave portion is substantially equal to the radius of the second concave portion.

6. The low-sidelobe dual-band and broadband flat endfire antenna of claim 5, wherein the radius of the first concave portion is between 5 mm and 8 mm.

7. The low-sidelobe dual-band and broadband flat endfire antenna of claim 1, which is operated between 2.4 GHz band and 5 GHz band.

8. The low-sidelobe dual-band and broadband flat endfire antenna of claim 1, wherein the first radiator and the second radiator are made of metal.

9. The low-sidelobe dual-band and broadband flat endfire antenna of claim 8, wherein the first radiator and the second radiator are made of copper.

10. The low-sidelobe dual-band and broadband flat endfire antenna of claim 1, wherein the refraction portion is made of metal.

11. The low-sidelobe dual-band and broadband flat endfire antenna of claim 10, wherein the refraction portion is made of copper.

12. The low-sidelobe dual-band and broadband flat endfire antenna of claim 1, wherein the conductive element is a coaxial cable.

13. The low-sidelobe dual-band and broadband flat endfire antenna of claim 1, wherein the substrate is made of fiberglass reinforced epoxy resin (FR-4).

14. The low-sidelobe dual-band and broadband flat endfire antenna of claim 1, further comprising:

a first feed point, which is disposed on the first electrically connecting portion and electrically coupled to one of the conductive body and the grounded conductor; and a second feed point, which is disposed on the second electrically connecting portion and electrically coupled to the conductive body or the grounded conductor.

* * * * *